United States Patent [19]

Ericson, Jr.

[11] 4,180,851

[45] Dec. 25, 1979

[54] VENTILATED LAMP GUARD

[75] Inventor: John E. Ericson, Jr., Willoughby, Ohio

[73] Assignee: Ericson Manufacturing Company, Willoughby, Ohio

[21] Appl. No.: 847,246

[22] Filed: Oct. 31, 1977

[51] Int. Cl.[2] ..... F21V 11/12; F21V 17/04

[52] U.S. Cl. ..... 362/378; 362/294; 362/373

[58] Field of Search ..... 362/373, 294, 376, 377, 362/378, 145, 218, 350, 453, 454

[56] References Cited

U.S. PATENT DOCUMENTS

| | | | |
|---|---|---|---|
| 1,430,354 | 9/1922 | Burdick | 362/294 |
| 2,878,371 | 3/1959 | Hanlin | 362/294 |
| 2,945,946 | 7/1960 | Moffatt | 362/294 |
| 3,119,567 | 1/1964 | Schwartz | 362/294 |
| 3,609,348 | 9/1971 | Marasco | 362/363 |
| 3,767,913 | 10/1978 | Trevithick | 362/378 |

*Primary Examiner*—Samuel W. Engle
*Assistant Examiner*—Edward F. Miles

[57] ABSTRACT

There is provided an improved lamp bulb guard having a circular tubular body portion, an inwardly flared portion and a circular tubular neck portion. Circumferentially spaced ventilating towers are provided. Each tower has a top portion, a front wall portion, and side wall portions. Vertically extending slots are provided, and each slot is protected by a baffle located radially inwardly thereof.

8 Claims, 3 Drawing Figures

VENTILATED LAMP GUARD

BACKGROUND OF THE INVENTION AND PRIOR ART

The present invention relates, as indicated, to a ventilated lamp bulb guard. These lamp guards are preferably molded from a transparent or translucent, moldable, heat resistant, synthetic organic polymer. These guards have a generally bell-like shape with a lamp socket receiving circular tubular coaxial neck portion.

A typical example of lamp guards of the type to which the improvements of the present invention relate is shown in U.S. Pat. No. 3,609,348 to Marasco. This patent shows a strong rigid translucent bell-like lamp guard with a tubular neck portion adapted to encircle and lockingly engage an electric socket. Ventilating means are provided by a series of holes extending through the flared portion.

Another patent of the same general type is the patent to Trevithick U.S. Pat. No. 3,767,913 which discloses a ventilated lamp guard which is characterized by a plurality of horizontally extending ventilating slots in the upper portion of the device and characterized by a radially inwardly disposed curtain wall behind each slot to deflect any liquid which may enter through the ventilating slot away from contact with the hot bulb.

The present invention provides an improved ventilating tower projecting from the flared portion.

BRIEF STATEMENT OF THE INVENTION

Briefly stated, the present invention is in a lamp bulb guard of the type generally known in the art and including an improvement which comprises a plurality of circumferentially spaced ventilating towers projecting from the flared portion. Each of the towers includes a generally radially extending top portion, a front wall portion and side wall portions. At least one axially extending slot is provided in each of the towers to provide for ventilation of the lamp bulb guard when in use. In preferred embodiments of the invention, there is provided adjacent each of the vertically extending slots, a vertically extending baffle member disposed in liquid deflecting relation to the slot and near, but radially inwardly of the slot.

BRIEF DESCRIPTION OF THE DRAWINGS

The improvements of the present invention will be better understood by having reference to the annexed drawings wherein.

DETAILED DESCRIPTION OF THE DRAWINGS

In the same manner as the prior art, the lamp guards herein are characterized by a substantially circular tubular, preferably translucent or transparent body having a flaring, preferably dome-like upper portion. The flaring or dome-like upper portion converges to a second circular tubular neck portion which is adapted to encircle a lamp bulb socket housing in a manner firmly but removably holding the lamp bulb guard on the socket.

The entire lamp guard is preferably injection molded from a light-transmitting organic polymer known in the art, for example, "Lexan" (trademark) which is irradiated stabilized nonflammable heat resistant polycarbonate resin.

As indicated, the improvement in the present invention is in the provision of tower ventilating means projecting from the flared portion. In lamp guards of this type, it is necessary to provide ventilation means for removal of heat generated by the lamp bulb, and at the same time, protect the lamp bulb from impact either with solid objects, or from rain water, particularly wind blown rain water.

Figure 1:
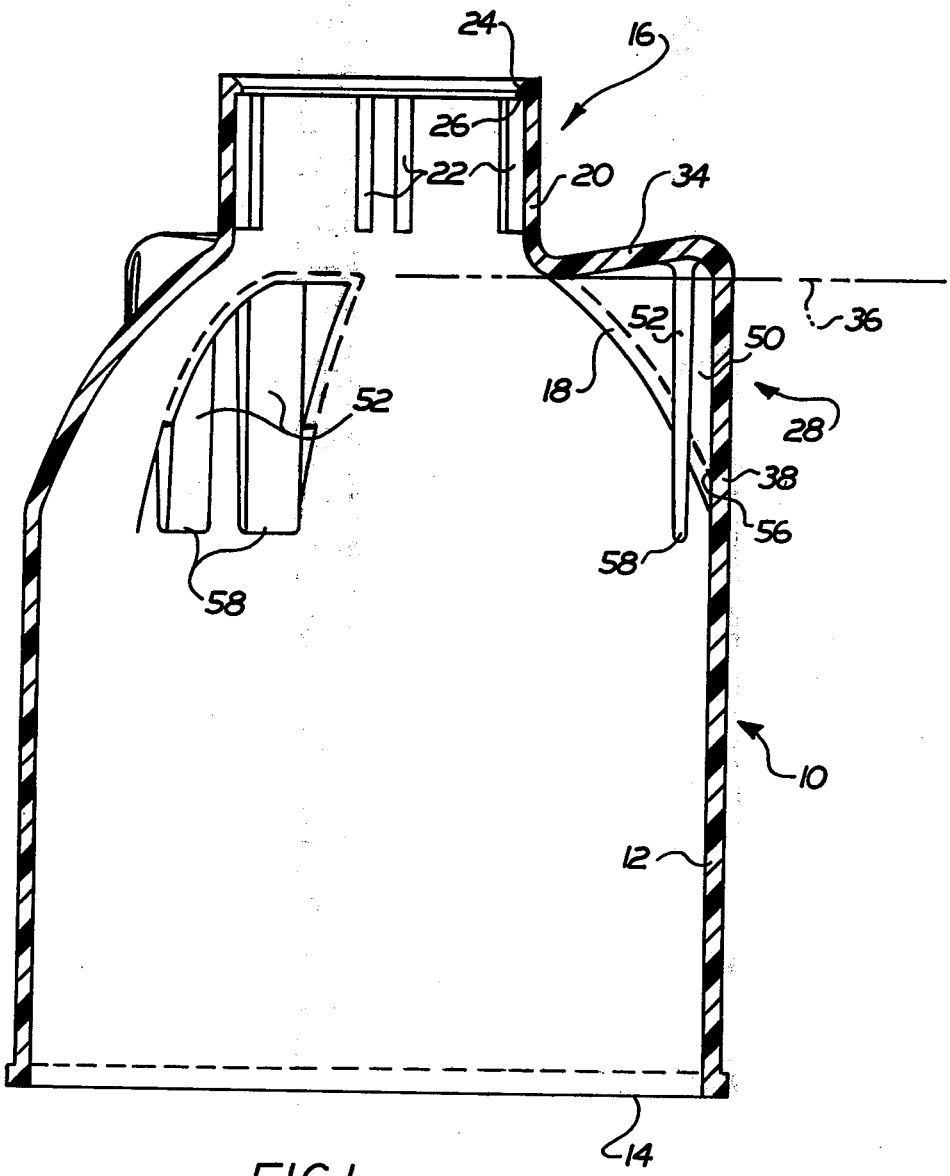
FIG. 1 is a diametric section of a lamp guard in accordance with this invention as it appears in the plane indicated by 1—1 in FIG. 2.

Referring more particularly to FIG. 1, there is shown in fragmentary cross sectional view, a lamp guard generally indicated by the numeral 10 in accordance with the present invention. In the preferred embodiment shown in FIG. 1, the lamp guard 10 is composed of a skirt portion 12 which is in the form of a circular tubular portion terminating at its free end 14 in a wide mouth opening. The opposite end of the lamp guard 10 is provided with a smaller diameter neck portion generally indicated by the numeral 16 which is also a circular tubular configuration. Joining the neck portion 16 and the skirt portion 12, there is provided an intermediate flared portion 18. The flared portion 18 may have any convenient geometrical configuration, it being a truncated hemispherical configuration as shown in FIG. 1. The neck portion 16 is conveniently dimensioned and configured for removable locking engagement with the housing of an electric light bulb socket and includes a tubular portion 20 of circular cross section conveniently reinforced with axially extending ribs 22. The distal extremity of the neck portion 16 terminates in an inwardly directed truncated conical surface 24 which facilitates attachment of the lamp guard to an electric light bulb socket housing. A lip such as the lip 26 may be provided for locking engagement with a corresponding projection of the electric light bulb socket housing. The tubular portion 20 may be provided with axially extending slits as shown in the U.S. Pat. to Marasco No. 3,609,348 to allow a certain amount of flexibility in the neck portion 16 for convenient attachment to and removal from an electric light bulb socket housing (not shown).

Figure 2:
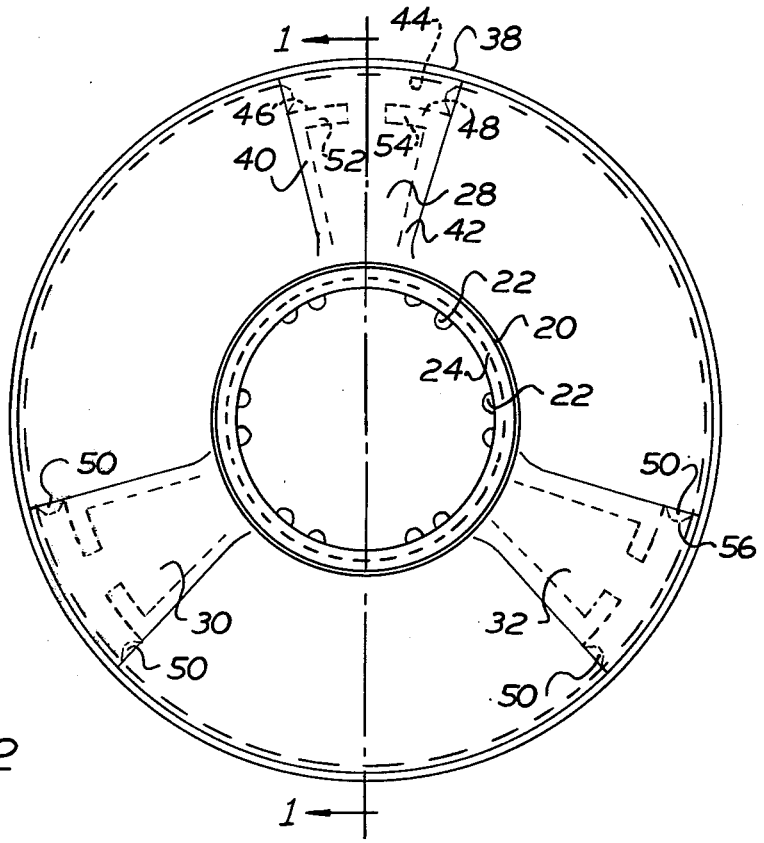
FIG. 2 is a top view of the lamp guard shown in FIG. 1.
Figure 3:
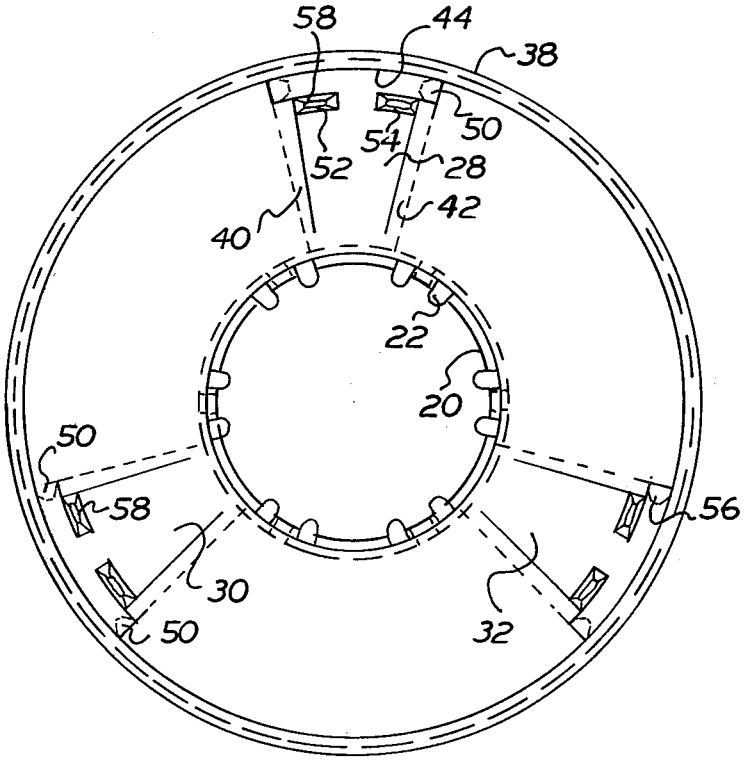
FIG. 3 is a bottom view of the lamp guard shown in FIG. 1.

As shown in the top plan view of FIG. 2 and the bottom plan view of FIG. 3, there are provided ventilating towers 28, 30, and 32 in circumferentially spaced relation at 120° intervals. The tower 28 is shown in cross section in FIG. 1, and comprises a top portion 34 which extends substantially radially outwardly from the base of the neck portion 16. In the preferred embodiment of FIG. 1, it will be observed that the roof portion 34 is sloped at an angle of about 10° to the axis line 36. The tower 28 also includes a front wall portion 38 which is conveniently an extension of the circular tubular section 12. As best shown in FIG. 3, the tower 28 also includes side wall portions 40 and 42. Between the inner face 44 of the tower front 38, and the radially outward extremities 46 and 48 of the side wall portions 40 and 42, respectively, there is provided a vertically extending slit 50, best shown in FIGS. 1 and 2. The slit 50 communicates between the exterior of the lamp guard 10 and the interior thereof and provides for ventilation.

To deflect any wind driven rain, for example, which may enter the lamp guard through the slits 50 (there being one on either side of the tower 28), there is provided a baffle or deflector 52. In like manner, a deflector 54 is provided for the second axially extending slot on the opposite side of the tower and corresponding to the slot 50 shown in FIGS. 1 and 2. The axial length of the slot 50 corresponds to the inner surface of the top portion 34 and approximately the point of tangency indicated at 56 between the front wall 38 and the side wall 42 with the flared portion 18. It will be observed as shown in FIG. 1 that the baffle 52 has an axial length which is greater than the axial extent of the slot 50. Rain water driven through the slot 50 which might otherwise proceed toward the electric light bulb is deflected by the baffle 52 and carried by gravity to the distal extremity 58, a position outside of any wind stream and also at a radius greater than the diameter of the electric light bulb from which point it is permitted to drip harmlessly out of the lamp guard. The distal extremity 58 may be sharpened or molded with a sharp edge if desired.

Although a preferred embodiment of the device has been shown in the annexed drawings with three ventilating towers at 120° intervals, it will be understood that a plurality of such towers from two to four or five in number may be provided. Larger diameter, higher power bulbs may require more numerous ventilating towers. Also, from the standpoint of casting, it is desirable that the baffles 52 and 54, for example, should be tapered (as best shown in FIG. 3) generally in a direction away from the top of the tower to a narrower cross section at the distal extremity 58. It should also be noted that the baffles 52 and 54 are circumferentially spaced from each other to provide a vertical channel for passage of air therebetween and to a position for exit through the axially extending slots such as the slot 50. In other modifications, the roof or top portion 34 of the tower 28 may extend at right angles to the neck portion 16 or be sloped in a direction opposite to that shown in FIGS. 1 and 2. In the preferred embodiment shown in the drawings, the baffles 52 and 54 of the tower 28, for example, are cast so as to be integral not only with the top portion 34, but respectively with the side portions 40 and 42.

It will be seen from the foregoing that the ventilating towers of the present invention provide for adequate ventilation of the lamp guard for adequate protection of the glass envelope of the bulb, and improve the rigidity of the dome shaped portion 18.

What is claimed is:

1. In a lamp bulb guard having a generally cylindrical, hollow body adapted to enshroud a lamp bulb therein to protect said bulb from contact with liquid and solid objects, said hollow body including an inwardly flared portion terminating in an axially extending generally circular tubular neck portion adapted to circumvallate an electrical socket for said lamp bulb, and means for attaching said neck portion to the electrical socket, the improvement which comprises a plurality of circumferentially spaced ventilating towers projecting from said flared portion, each of said towers including a generally radially extending top portion, a front wall portion extending between the top portion and said hollow body, and side wall portions extending between said top and portion and said inwardly flared portion, at least one axially extending slot in each of said towers to provide for ventilation of said lamp bulb guard when in use, and an axially extending baffle adjacent said at least one slot and positioned within said tower near but radially inwardly of said front wall portion, said baffle having an axial length greater than the axial length of said slot, and a width less than the circumferential width of said tower.

2. A lamp bulb guard in accordance with claim 1 wherein said baffle is axially tapered in a direction away from the top of said tower.

3. A lamp bulb guard in accordance with claim 1 wherein said ventilating towers are circumferentially spaced at 120° intervals.

4. A lamp bulb guard in accordance with claim 1 wherein each of said ventilating towers is provided with two axially extending slots.

5. A lamp bulb guard in accordance with claim 4 wherein said slots are located between the radially inner face of the front portion of said tower and the radially outer edge of each of said side wall portions, respectively.

6. A lamp bulb guard in accordance with claim 5 wherein said baffles adjacent each of said slots, respectively, in a given tower are circumferentially spaced for the entire axial extent thereof.

7. A lamp bulb guard in accordance with claim 1 in which the included angle between the top portion and the front portion of each of said towers is less than 90°.

8. A lamp bulb guard in accordance with claim 6 in which the baffles depend from the top of each of said towers and are joined respectively along one axially extending marginal edge thereof to the adjacent side wall portion.

* * * * *